US009453350B2

(12) United States Patent
Jaycock

(10) Patent No.: US 9,453,350 B2
(45) Date of Patent: Sep. 27, 2016

(54) SHUTTERING

(71) Applicant: KFIP LIMITED, Pyle (GB)

(72) Inventor: Andrew Peter Jaycock, Daventry (GB)

(73) Assignee: KFIP LIMITED, Pyle (GB)

( * ) Notice: Subject to any disclaimer, the term of this patent is extended or adjusted under 35 U.S.C. 154(b) by 0 days.

(21) Appl. No.: 14/517,199

(22) Filed: Oct. 17, 2014

(65) Prior Publication Data

US 2015/0035185 A1 Feb. 5, 2015

Related U.S. Application Data

(63) Continuation of application No. 12/726,656, filed on Mar. 18, 2010, now abandoned.

(30) Foreign Application Priority Data

Mar. 3, 2010 (EP) ..... 10002170

(51) Int. Cl.

| | |
|---|---|
| ***E04B 1/62*** | (2006.01) |
| ***E04G 11/06*** | (2006.01) |
| ***E02D 27/02*** | (2006.01) |
| ***E04G 11/36*** | (2006.01) |
| *E04B 5/32* | (2006.01) |

(52) U.S. Cl.

CPC ..... *E04G 11/06* (2013.01); *E02D 27/02* (2013.01); *E04G 11/36* (2013.01); *E04B 2005/322* (2013.01)

(58) Field of Classification Search

CPC ..... E04G 11/06
USPC ..... 52/396.02, 396.04; 404/47
See application file for complete search history.

(56) References Cited

U.S. PATENT DOCUMENTS

| | | | | |
|---|---|---|---|---|
| 4,346,542 | A | 8/1982 | Tateno | |
| 4,815,886 | A | 3/1989 | Madsen | |
| 4,841,704 | A | 6/1989 | Jarrell | |
| 5,042,211 | A | 8/1991 | Nestler | |
| 5,363,619 | A | 11/1994 | McPhee | |
| 5,450,699 | A | 9/1995 | Lee | |
| 5,568,710 | A | 10/1996 | Smith et al. | |
| 5,758,456 | A * | 6/1998 | Case | E04C 2/20 52/177 |
| 5,769,562 | A | 6/1998 | Jones | |

(Continued)

FOREIGN PATENT DOCUMENTS

| | | |
|---|---|---|
| DE | 29821784 U1 | 2/1999 |
| EP | 0360682 A1 | 3/1990 |

(Continued)

*Primary Examiner* — Beth Stephan
(74) *Attorney, Agent, or Firm* — Davis & Bujold PLLC; Michael J. Bujold

(57) ABSTRACT

A shuttering formwork suitable for use as sacrificial shuttering formwork includes an elongate body member having a base portion and a compression portion extending therefrom and presenting a free end that extends in a length direction of the elongate body member. The elongate body member has first and second sides, each comprising a compression portion side face and a base portion upper face. A strip element is releasably attachable to the free end of the compression portion. The compression portion side face and the base portion upper face of at least one side of the elongate body member are each a resiliently deformable surface. The base portion is provided with apertures for receiving mortar material. The shuttering formwork may be fabricated from a plastics material and have a hollow structure.

20 Claims, 4 Drawing Sheets

(56) References Cited

U.S. PATENT DOCUMENTS

| | | | |
|---|---|---|---|
| 5,910,087 | A | 6/1999 | Carter |
| 5,956,912 | A | 9/1999 | Carter et al. |
| 6,532,714 | B1 | 3/2003 | Ferm et al. |
| 6,722,097 | B2 | 4/2004 | Haslem et al. |
| 6,735,918 | B2 | 5/2004 | Haslem et al. |
| 6,948,291 | B2 | 9/2005 | Haslem et al. |
| 7,506,480 | B1 | 3/2009 | Chandler |
| 7,547,158 | B1 | 6/2009 | Mucci |
| 2004/0181869 | A1 | 9/2004 | Cowling |
| 2006/0260233 | A1 | 11/2006 | Schluter |
| 2009/0064619 | A1 | 3/2009 | Bowerman |

FOREIGN PATENT DOCUMENTS

| | | | |
|---|---|---|---|
| GB | 2357104 | B | 7/2002 |
| GB | 2391576 | B | 2/2004 |

* cited by examiner

SHUTTERING

CROSS REFERENCE TO RELATED APPLICATIONS

This application is a continuation of U.S. application Ser. No. 12/726,656 filed on Mar. 18, 2010, which claims priority of European patent application EP 10 002 170.8 filed on Mar. 3, 2010, the entire contents of these applications being hereby incorporated by reference herein.

FIELD

The present invention relates to shuttering, in particular to a shuttering formwork for poured concrete that is suitable for use as a sacrificial shuttering formwork.

BACKGROUND

Newly poured concrete, which is in a wet, fluid form, needs to be maintained in position until it has cured sufficiently to hold its own shape. When poured, the concrete is typically levelled and then left to set. When forming a concrete slab, physical features, such as existing walls and kerbs, may be used to define physical boundaries for retaining the poured concrete in place whilst it sets. Alternatively, structures known as shuttering or formwork may be arranged to provide support for the edges of the bed of poured concrete. Such a structure may be of a temporary type, for example steel shuttering, which is removed after the poured concrete has hardened. However, the structure may be sacrificial, and hence left in place. A problem with sacrificial shuttering formwork is that it must withstand the expansion forces of the concrete as it cures and also have appropriate qualities for it to be used as sacrificial apparatus.

BRIEF SUMMARY OF THE INVENTION

According to a first aspect of the present invention there is provided a shuttering formwork comprising: an elongate body member comprising a base portion and a compression portion extending from said base portion substantially perpendicularly thereto and presenting a free end that extends in the length direction of said elongate body member, said elongate body member comprising a first side and a second side, each side comprising a compression portion side face and a base portion upper face; and a strip element releasably attachable to said free end of said compression portion; the compression portion side face and the base portion upper face of at least one side of said first and second sides of said elongate body member each being a resiliently deformable surface.

In a preferred embodiment, the base portion, the compression portion and the strip element each comprise a plastics material and each comprise a hollow structure.

According to a first aspect of the present invention there is provided a method of pouring a concrete slab, said method comprising the steps of a) receiving a shuttering formwork according to the first aspect, b) positioning the elongate body member of said received shuttering formwork upon mortar material such that mortar material is received within the base apertures of the base element, and c) attaching the strip element of said shuttering formwork to the free end of the compression portion of said elongate body member.

BRIEF DESCRIPTION OF DRAWING FIGURES

An embodiment of the present invention will now be more particularly described by way of example and with reference to the accompanying drawings, in which.

DETAILED DESCRIPTION

Figure 1:
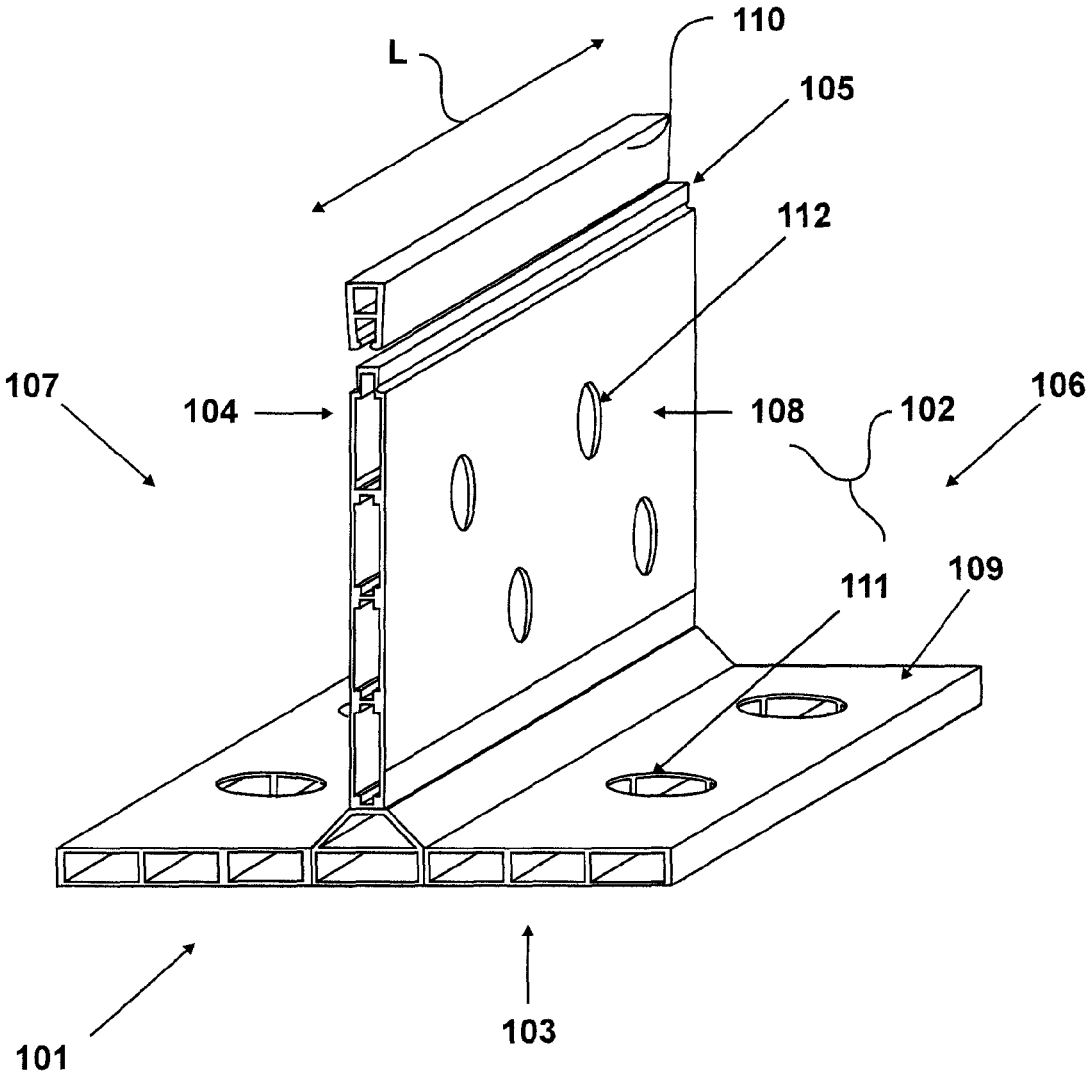
FIG. 1 is a perspective view of a shuttering formwork; suitable for use as sacrificial shuttering formwork.

A shuttering formwork suitable for use as sacrificial shuttering formwork is shown in FIG. 1. Shuttering formwork 101 comprises an elongate body member 102 comprising a base portion 103 and a compression portion 104 extending from the base portion 103 substantially perpendicularly thereto and presenting a free end 105 that extends in the length direction L of said elongate body member 102. The elongate body member 102 comprises a first side 106 and a second side 107, each side 106, 107 comprising a compression portion side face, such as compression portion side face 108 of first side 106, and a base portion upper face, such as base portion upper face 109 of first side 106. Shuttering formwork 101 also comprises a strip element 110 that is releasably attachable to the free end 105 of the compression portion 104.

Advantageously, the compression portion side face and the base portion upper face of at least one side 106, 107 of the elongate body member 102 are each a resiliently deformable surface. Hence, for example, compression portion side face 108 of first side 106 and base portion upper face 109 of first side 106 are each a resiliently deformable surface.

Thus, in an embodiment, the compression portion side face and the base portion upper face of only one side of the elongate body member are resiliently deformable surfaces. In an alternative embodiment, the compression portion side face and the base portion upper face of both sides of the elongate body member resiliently deformable. A shuttering formwork in which the compression portion side face and the base portion upper face of both sides of the elongate body member are each a resiliently deformable surface can be used between two concrete bays, separating them.

In use, the base portion 103 of the elongate body member 102 is typically located substantially horizontally upon a flat foundation layer, such as a level layer of bedding mortar, such that the compression portion extends substantially vertically.

In an embodiment, the base portion 103 defines a plurality of base apertures therethrough on each of the first and second sides 106, 107 of the elongate body member 102, such as base aperture 111 on the first side 106 of the elongate body member 102. These base apertures are provided for receiving mortar material, to advantageously anchor the base portion in a desired location and, in turn, to increase the stability of the shuttering formwork 101 when in use.

In an embodiment, the compression portion 104 also defines a plurality of compression portion apertures therethrough, such as compression portion aperture 112. These compression apertures are provided for receiving dowel, or tie, bars, such as may be used to stabilizing, supporting or connecting.

Figure 2:
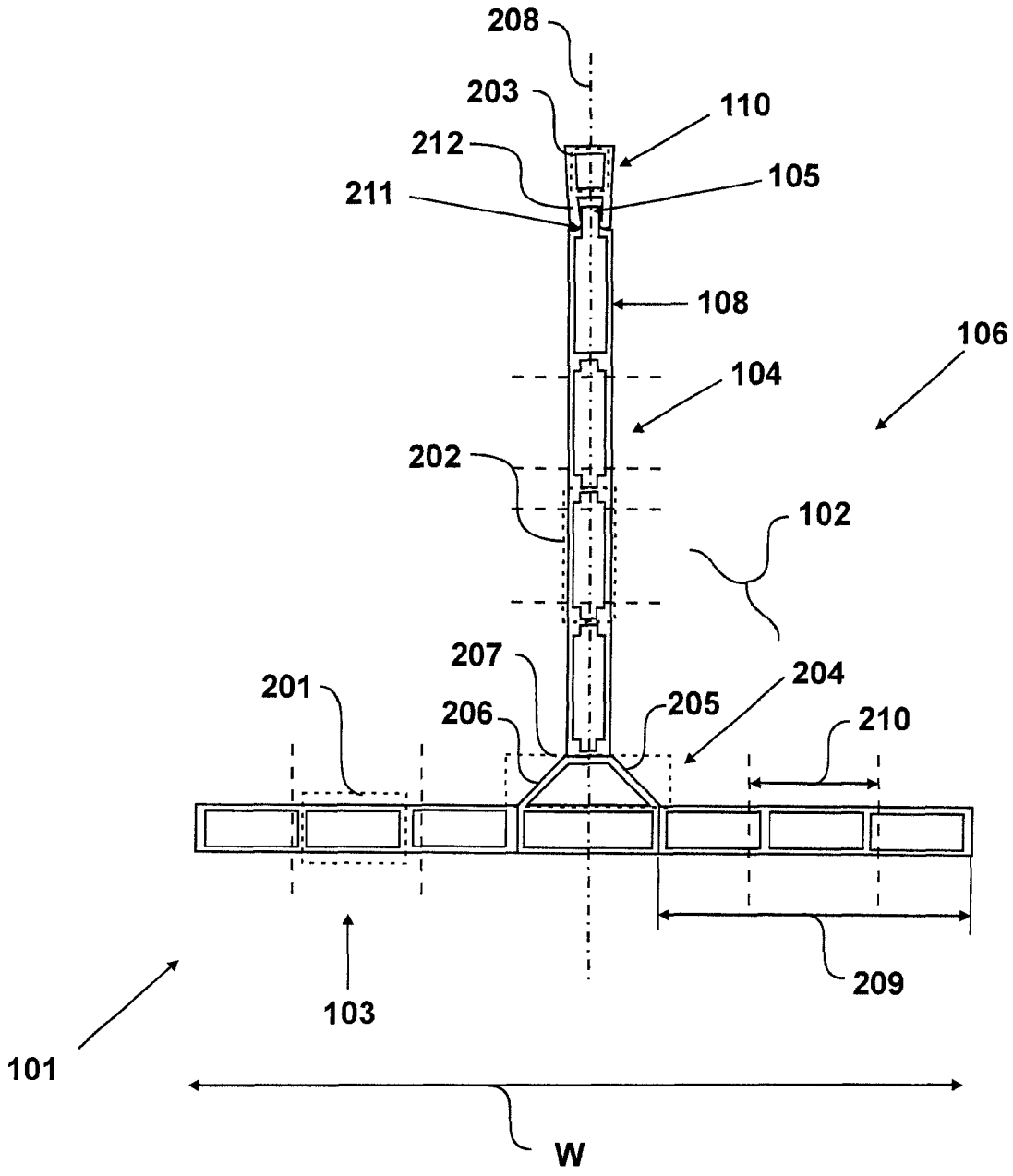
FIG. 2 is a side view of the shuttering formwork of FIG. 1.

Shuttering formwork 101 is shown in FIG. 2, with the strip element 110 releasably attached to the free end 105 of the compression portion 104 of the elongate body member 102.

In a preferred embodiment, the base portion 103, the compression portion 104 and the strip element 110 each comprise a plastics material. The use of a relatively cheap plastics material allows the shuttering formwork to be sacrificial. A plastics material also allows for easy cutting of the elongate body member and the strip element on site, to a desired length. In an example, the plastics material is UPVC (Unplasticized Polyvinyl Chloride) material. In a preferred application, the UPVC material is recycled UPVC material. In a preferred embodiment, the base portion 103, the compression portion 104 and the strip element 110 each comprise a hollow structure. As illustrated, in a preferred example, the hollow structure of each of the base portion 103, the compression portion 104 and the strip element 110 each have a cross-section that comprises at least one substantially rectangular shape. The substantially rectangular shape may be regular or irregular and may have only 4 or more than 4 sides. The substantially rectangular shape may vary between the cross-sections of the base portion 103, the compression portion 104 and the strip element 110, as can be seen in this illustrated example from comparison of the substantially rectangular shape 201 of base portion 103, substantially rectangular shape 202 of compression portion 104 and substantially rectangular shape 203 of strip element 110. The hollow structures of the base portion 103, the compression portion 104 and the strip element 110 are provided by first and second spaced apart walls that are connected by flutes or cross-pieces. The first and second walls may be substantially parallel to each other, or may be slightly angled towards or away from each other. It is to be appreciated that any suitable type of hollow structure may be used for the base portion and the compression portion at least of the shuttering formwork as appropriate.

The use of a hollow plastics structure in the shuttering formwork provides several advantages. It serves to reduce the overall weight of the shuttering formwork. This conveniently facilitates manual handling and transportation. A hollow structure provides the base portion and compression portion with sufficient strength to withstand forces thereon resultant from the concrete pour. A hollow plastics structure of the base portion and compression portion may provide the base portion and the compression portion with a resiliently deformable surface. Thus, in this example, the compression portion side face 108 of first side 106 and base portion upper face 109 of first side 106 are each a resiliently deformable surface provided by the hollow plastics structure. The resiliently deformable surface of the compression portion side face 108 allows for expansion of the poured concrete during setting. In this way, the shuttering formwork 101 has an integral compression joint. The resiliently deformable surface of the base portion upper face 109 advantageously increases the stability of the shuttering formwork 101 when in use.

In this example, at the junction between the base portion 103 and the compression portion 104 of the elongate body member 102 is provided a connector portion 204, which has a pair of outwardly extending angled flange members 205, 206. It can be seen that the connector 204 portion also has a cross-section that comprises at least one substantially rectangular shape 207. The connector portion 204 also serves to increase the strength of the shuttering formwork 101.

In this illustrated example, the compression portion 104 is substantially centrally located in the width direction W of the elongate body member 102. In this example, the elongate body member 102, and the elongate body member 102 with the strip element 110 attached to the free end 105 of the compression portion 104, is substantially symmetrical about a centre line 208. However, it is to be appreciated that other arrangements may be suitable. It is also to be appreciated that other hollow structures may be suitable. In a preferred embodiment, the elongate body member 102 and the strip element 110 are formed by an extrusion process. Again, however, any suitable manufacturing technique or combination of manufacturing techniques may be utilized.

The base portion upper surface of each side of the elongate body member, such as base portion upper surface 109 of side 106 has a width 209. In an example, the base apertures have a diameter, as indicated at 210, that it equal to or greater than 50% of the width dimension of the respective base portion upper face.

According to this illustrated example, the strip element 110 is securable to the free end 105 of the compression portion 104 by a friction fit. As also featured in this example, the strip element 110 is securable to the free end 105 of the compression portion 104 in a predetermined condition by a friction fit. As shown in this Fig., the upper edge of the free end 105 of the compression portion 104 is narrowed to provide a pair of shoulders, such as shoulder 211, upon which a pair of legs, such as leg 212, of the strip element 110 may sit, such that the strip element 110 straddles the free end 105 of the compression portion 104.

Figure 3:
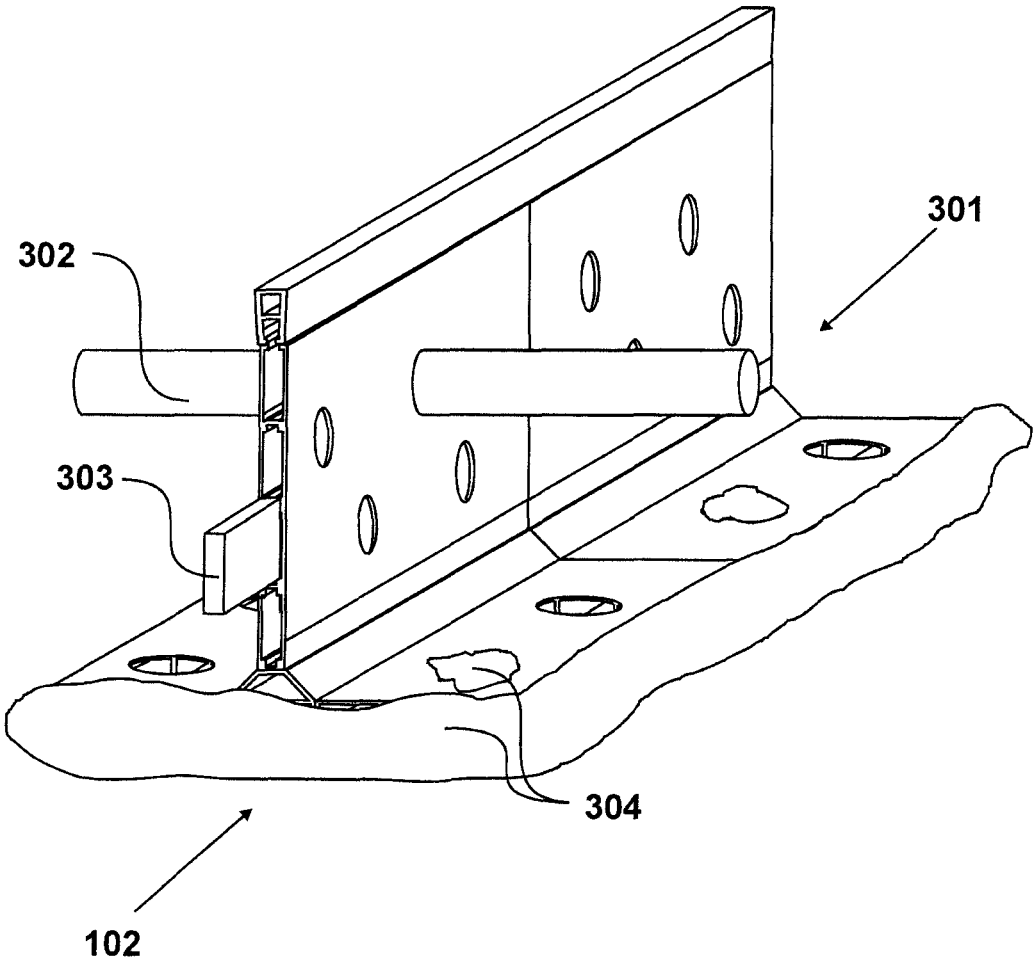
FIG. 3 illustrates features of the shuttering formwork of FIGS. 1 and 2.

Shuttering formwork 101 is shown in FIG. 3, in which elongate body member 102 is adjacent a second like elongate body member 301. The elongate body members 102, 301 are arranged in a substantially linear arrangement, such that they extend in the same direction in the form of a rail. A dowel bar 302 is shown located within a compression aperture of compression portion 104. The ends of the elongate body member 102 are open. The shuttering formwork 101 may further comprise a plurality of end clip elements, such as end clip element 303, that may be located within the hollow structure of the compression portion 104, and used to connect the ends of adjacent like elongate body members. In this Fig., the elongate body member 102 is shown located upon mortar material 304, such that mortar material is received within base apertures of the base portion 103. As previously discussed, the shuttering formwork 101 is located to act as a retaining edge for poured concrete to hold it in place whilst it cures. The hollow resiliently deformable surfaces of at least one side of the elongate body member enable it to accommodate expansion of the concrete during the curing process and function to hold the elongate body member in position during this same process. The shuttering formwork provides an integral expansion joint.

Figure 4:
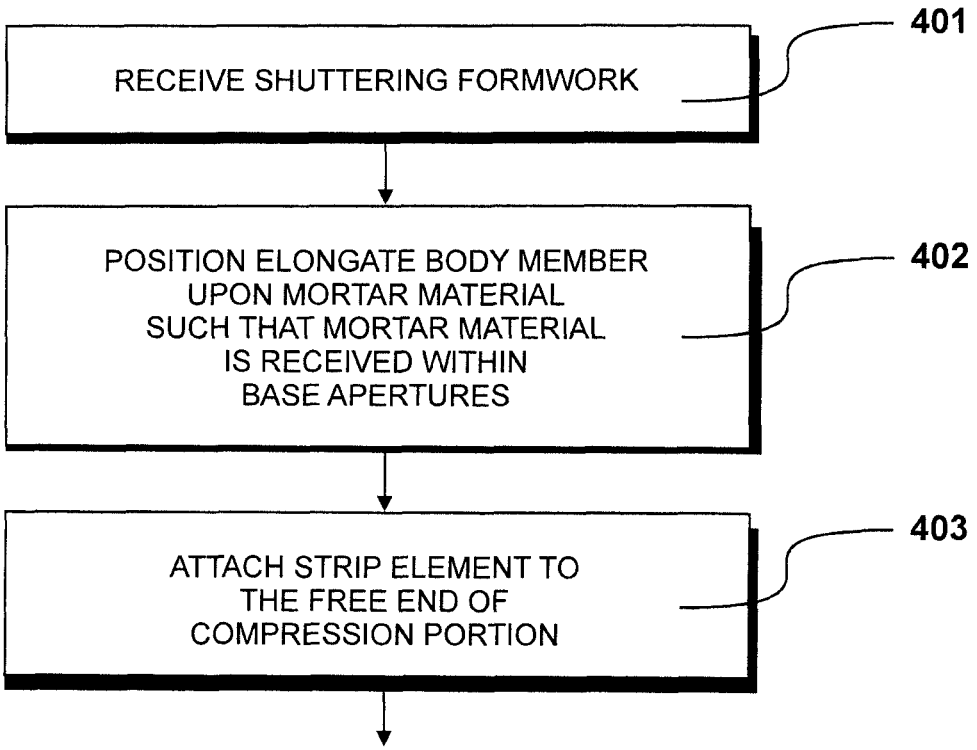
FIG. 4 illustrates steps in a method of use of the shuttering formwork of FIGS. 1 to 3.

Steps in a method of use of shuttering formwork as described herein are shown in FIG. 4. At step 401, shuttering formwork is received. Then, at step, the elongate body member of the received shuttering formwork is position upon mortar material such that mortar material is received with base apertures of the base portion. The strip element is then attached to the free end of the compression portion. A strip element may be dimensioned to fit along a single compression portion or along more than one compression portion.

When the shuttering formwork is suitably anchored, typically when the bedding mortar has cured, at a desired site, the concrete may then be poured. Being sacrificial, the shuttering formwork may be left in place and not removed after the concrete has hardened. However, the strip element may be removed, leaving the elongate body member. The resultant gap may then be filled in with a joint sealing material for example.

In an example, a shuttering formwork has an elongate body that has a length dimension of 3000 mm in length, a width dimension of 155 mm, and a height dimension of 135 mm. Four base apertures are defined on each side of the elongate body. It is to be appreciated however, that the dimensions of the elongate body and strip element may vary between applications, and that the number and arrangement of defined base apertures and, where provided, compression portion apertures, may also vary between applications, The shuttering formwork serves to increase the ease and speed of which concrete pours may be completed. Units of the shuttering formwork are mechanically connectable together, such that no specialist tools or specially trained operatives are required. This serves to reduce labor time and cost, in turn allowing more volume of concrete to be poured within a particular period of time. Shuttering formwork fabricated from a plastics material can also be fuel and oil resistant, and non-conductive, allowing it be used in a wide range of applications, for example petrol forecourts. This fabrication provides the shuttering formwork with durability and overcomes the problems of rotting or rusting when in situ when used as a sacrificial shuttering formwork. The shuttering formwork does not require anchoring stakes to be used.

What is claimed is:

1. A shuttering formwork comprising:

an elongate body member comprising a hollow base portion and a hollow compression portion extending from said base portion substantially perpendicularly thereto and presenting a free end that extends along a length direction of said elongate body member;

said elongate body member comprising a first side and a second side, each of said first side and said second side comprising a compression portion side face and a base portion upper face, the compression portion side face and the base portion upper face being flat-face planar walls of the compression portion and the base portion, respectively;

a strip element releasably attachable to said free end of said compression portion, said base portion, said compression portion and said strip element each comprise a plastics material, said strip element comprises a hollow structure, and the flat-face planar wall of the compression portion side face and the flat-face planar wall of the base portion upper face of at least one side of said first and second sides of said elongate body member each being resiliently deformable.

2. The shuttering formwork as claimed in claim 1, wherein the flat-face planar wall of the compression portion side face and the flat-face planar wall of the base portion upper face of both said first and second sides of said elongate body member are each resiliently deformable.

3. The shuttering formwork as claimed in claim 1, wherein the hollow base portion, the hollow compression portion and the hollow structure of the strip element each have a cross-section that comprises at least one substantially rectangular shape.

4. The shuttering formwork as claimed in claim 1, wherein the hollow compression portion is substantially centrally located along a width direction of said elongate body member.

5. The shuttering formwork as claimed in claim 1, wherein the hollow base portion defines a plurality of base apertures therethrough on each of said first side and said second side of said elongate body member for receiving mortar material.

6. The shuttering formwork as claimed in claim 5, wherein each of said base apertures has a diameter that is equal to or greater than 50% of the width dimension of the respective base portion upper face.

7. The shuttering formwork as claimed in claim 1, wherein said strip element is securable to said free end of the hollow compression portion by a friction fit.

8. The shuttering formwork as claimed in claim 1, wherein said strip element is securable to said free end of the compression portion in a predetermined condition by a positive mechanical fit.

9. The shuttering formwork as claimed in claim 1, wherein the hollow compression portion defines a plurality of compression portion apertures therethrough for receiving a respective dowel bar.

10. The shuttering formwork as claimed in claim 1, further comprising a plurality of end clip elements for joining together an end of said elongate body member and an end of a second elongate body member.

11. The shuttering formwork as claimed in claim 1, wherein said plastics material is UPVC material.

12. The shuttering formwork as claimed in claim 11, wherein said UPVC is recycled UPVC material.

13. A method of setting up shuttering formwork for a concrete pour, said method comprising the steps of:

a) receiving the shuttering formwork as claimed in claim 5, b) positioning the elongate body member of said received shuttering formwork upon mortar material such that mortar material is received within the base apertures of the base element, and c) attaching the strip element of said received shuttering formwork to the free end of the compression portion of said elongate body member.

14. A shuttering formwork for retaining an edge to concrete during pouring and curing of the concrete, the shuttering formwork comprising:

(a) an elongate planar base having an upper flat face for location horizontally during the pouring and curing of the concrete;

(b) only a single upstanding wall, and the single upstanding wall:

(i) is upstanding perpendicularly from the upper flat face of the elongate planar base, (ii) is the sole wall which is upstanding from the elongate planar base, (iii) has a concrete-retaining flat face for defining the edge by retaining the edge of the concrete during the pouring and curing of the concrete, (c) an elongate strip element selectively attachable lengthwise by friction fit to the top of the single upstanding wall; and the elongate planar base and the single upstanding wall are each of hollow resiliently deformable plastics for resilience to deformation in retaining the edge during the pouring and curing of the concrete.

15. The shuttering formwork as claimed in claim 14, wherein the elongate planar base and the single upstanding wall are of extruded plastics.

16. The shuttering formwork as claimed in claim 14, wherein the single upstanding wall is centrally located along a width direction of the elongate planar base.

17. The shuttering formwork as claimed in claim 14, wherein the elongate planar base has a hollow structure comprising spaced-apart walls that are interconnected by cross-pieces.

18. The shuttering formwork as claimed in claim 14, wherein the single upstanding wall has a hollow structure comprising spaced-apart walls that are interconnected by cross-pieces.

19. The shuttering formwork as claimed in claim 14, wherein the elongate planar base portion, the single upstanding wall and the strip element each have a same cross sectional thickness.

20. The shuttering formwork as claimed in claim 14, wherein each of the single upstanding wall and the strip element have first and second opposed flat-face planar walls, the first flat-face planar wall of the strip element is substantially parallel to and a continuation of the first flat face planar wall of the single upstanding wall while the second flat-face planar wall of the strip element is substantially parallel and a continuation of the second flat-face planar wall of the single upstanding wall.

* * * * *